US007610643B2

(12) United States Patent
Hellhake

(10) Patent No.: US 7,610,643 B2
(45) Date of Patent: Nov. 3, 2009

(54) METHOD OF MONITORING THE ROTATIONAL MOVEMENT OF A WASHING MACHINE DRUM

(75) Inventor: Wolfgang Hellhake, Lippstadt (DE)

(73) Assignee: Miele & Cie. KG, Guetersloh (DE)

( * ) Notice: Subject to any disclaimer, the term of this patent is extended or adjusted under 35 U.S.C. 154(b) by 688 days.

(21) Appl. No.: 11/247,126

(22) Filed: Oct. 11, 2005

(65) Prior Publication Data

US 2008/0127428 A1 Jun. 5, 2008

(30) Foreign Application Priority Data

Oct. 11, 2004 (DE) ..... 10 2004 049 650

(51) Int. Cl.
*D06F 35/00* (2006.01)

(52) U.S. Cl. ..... 8/158; 8/159; 68/12.06; 68/23.1

(58) Field of Classification Search ..... 8/158, 8/159; 68/23.1, 12.06
See application file for complete search history.

(56) References Cited

U.S. PATENT DOCUMENTS 6,029,298 A * 2/2000 Dausch et al. ..... 8/159
6,327,729 B1 * 12/2001 Wunderlich et al. ..... 8/158
6,460,381 B1 * 10/2002 Yoshida et al. ..... 68/12.04
6,564,413 B2 * 5/2003 Braun et al. ..... 8/159
2003/0154557 A1 * 8/2003 Sears et al. ..... 8/158
2006/0075578 A1 4/2006 Hellhake

FOREIGN PATENT DOCUMENTS

| | | |
|---|---|---|
| DE | 42 25 769 A1 | 2/1994 |
| EP | 0 709 512 B1 | 5/1996 |
| JP | 02224796 | 9/1990 |
| JP | 10179978 A | 7/1998 |
| JP | 2004065408 | 3/2004 |

OTHER PUBLICATIONS

Omachi, Masanori, Apr. 3, 2004, JP 2004-65408A English machine translation.*
Miyajima, Minoru, Jul. 1998, JP 10-179978A English machine translation.*
Nakamura Kimihiko, Sep. 1990, JP 1990224796 A English translation.*
Nakamura, Kimihiko, Sep. 1990, JP 02224796A English Abstract.

* cited by examiner

*Primary Examiner*—Michael Barr
*Assistant Examiner*—Jason Y Ko
(74) *Attorney, Agent, or Firm*—Darby & Darby

(57) ABSTRACT

A method of monitoring a washing drum in a washing machine for impermissible or atypical movement during a first phase of a washing program as may result, for instance, from the presence of a child or animal in the drum, and of aborting the washing program upon detection of such impermissible movement.

6 Claims, 2 Drawing Sheets

METHOD OF MONITORING THE ROTATIONAL MOVEMENT OF A WASHING MACHINE DRUM

BACKGROUND OF THE INVENTION

1. Field of the Invention

Figure 1:
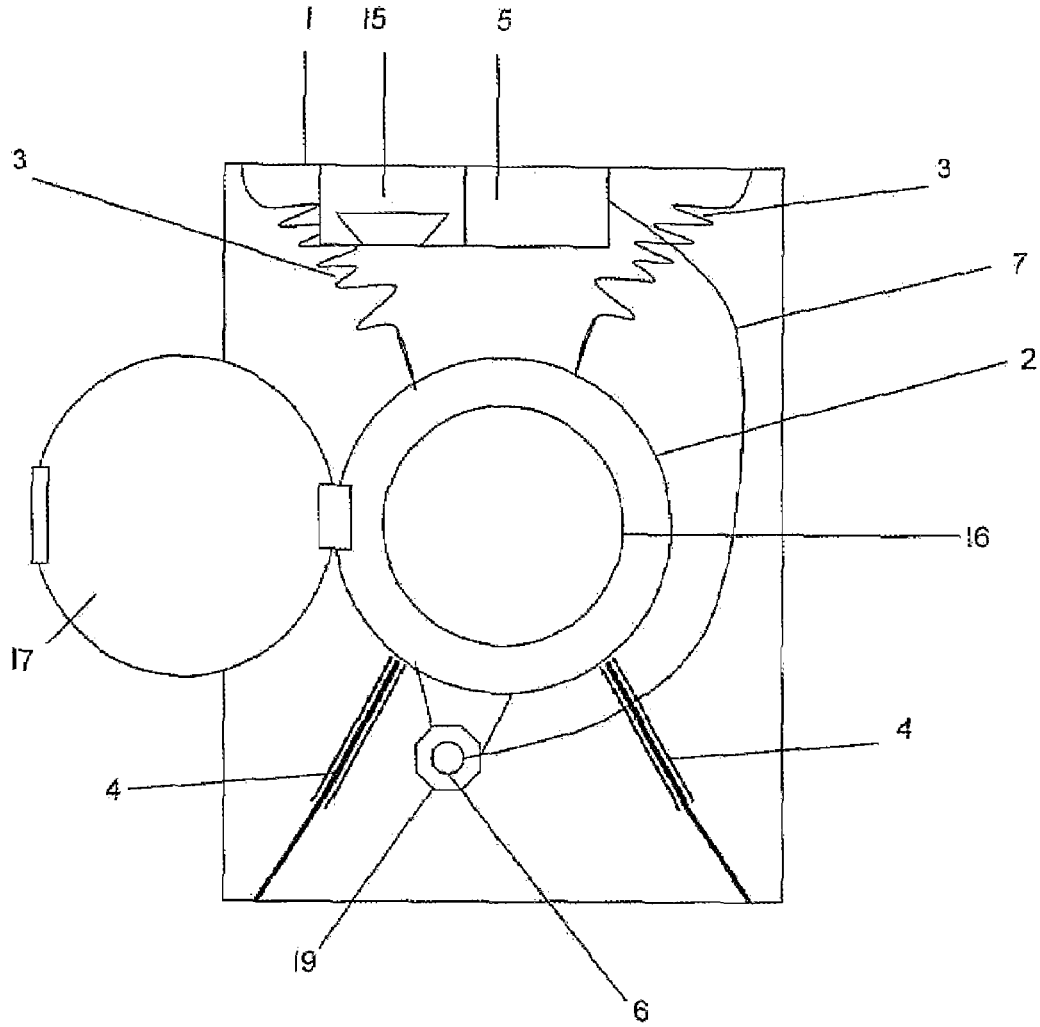

The invention, in general, relates to a method of monitoring the rotational movement of a washing machine drum and, more particularly to a method of the kind referred to in a washing machine provided with a housing, a washing fluid tub mounted for oscillatory movement therein, a drum rotatably mounted therein for receiving laundry and/or washing fluid and a motor for rotating the drum in at least one direction as well as an evaluation device for preventing the continuation of a washing program upon detecting an impermissible movement during a first phase of the washing program during the which the motor is inactive.

2. The Prior Art.

Such a method is generally known from the disclosure of Patent Abstracts of Japan No. JP 2004065408A. It is provided with a sensor for detecting an impermissible movement of the drum or of the washing fluid tub during an idle time between initiation and execution of the washing program. A similar method has been disclosed by Patent Abstracts of Japan No. JP 10179978 A. A motion sensor or acceleration sensor mounted at an upper portion of the tub recognizes a detected movement as originating from a child within the drum. Its proper function is, however, dependent upon movements of the child.

Yet another method has been disclosed by German Laid-open Patent Specification No. DE 42 25 769 A1. In this case, weight present within the drum is detected by a weight sensor prior to initiation of a washing program and if the weight exceeds a predetermined threshold value the washing program is either not initiated or an alarm is activated. The method is suitable only for washing loads of no more than 4.5 or 5 kg of dry laundry, however. The method is unsuitable for larger washing machines with capacities of 8 kg of dry laundry because it cannot distinguish whether the detected weight originates with the permissible laundry in the drum or with a child of substantially the same weight.

European Patent Specification EP 0 709 512 B1 discloses a method of detecting the load within a drum. The number of rotations are monitored during reverse operation with a evaluation circuit determining the weight of the load as a function of the oscillatory behavior of the rotation signal.

OBJECT OF THE INVENTION

It is an object of the invention with simple means to improve the safety of, and thus protect from possible harm, a child present in the drum, accidentally or otherwise.

SUMMARY OF THE INVENTION

In the accomplishment of these and other objects, the invention provides a washing machine monitoring program for detecting an impermissible or atypical rotational movement of the drum during a first phase of the washing program.

Further features of the novel program will become apparent as the description of the invention unfolds hereafter.

The advantage derived from the method in accordance with the invention is that a very reliable recognition of a child (or pet) within the drum of a washing machine results in high safety and the prevention of possible hazards and injuries. A further advantage is that the method is extremely simple and cost-efficient, since it depends upon the utilization of sensors and/or detectors for the weight of laundry or rotational movement of the drum which are standard features of current washing machines. The method is practiced in a simple manner by monitoring during an initial phase the number of rotations or rotational movement of the drum upon starting the washing program or actuation of the start button. Even rotary movements by a small angle, e.g. less than 5 degrees, are detected and lead to a reliable recognition of a child or animal being accidentally or unintentionally within the drum. Since during this first phase the motor is inactive, i.e. the drum is not moved by the motor, a detected movement causes the washing program set by a user to be terminated or aborted. Still another advantage of the method in accordance with the invention resides in the fact that because of the sensitive response of the rotary movement sensor in detecting a rotary movement and because of the low mass of the drum even very weak movements can be detected during the first phase.

In an advantageous embodiment of the invention, water, and more particularly cold water, is fed into the tub and, thence, the drum upon start-up of the washing program or upon actuation of the start button. A child or animal sleeping or resting in the drum will thus be woken by the water or startled, and the unpleasant feeling of the water will prompt him to move. This will result in an even better recognition of a child or animal in the drum.

Both amount and temperature of the water initially fed into the drum are limited such that a child or animal can neither drown nor otherwise harmed. In this connection, it is useful or advantageous that the amount of the water is only a partial portion of the washing fluid required for a washing cycle.

Persons skilled in the art will understand that during the first phase of a washing program no detergents or other laundry agents are admitted to the tub and the drum. Thus, in an advantageous embodiment of the invention no laundry detergent or other substance is added to the water during an initial phase of the washing program. The water is caused to circumvent the detergent compartment of the washing machine during its initial feeding into the tub.

Upon recognizing the presence of a child in the drum as result of its movement during an idle phase, a visible or audible alarm may be activated and that the door of the washing machine may be automatically unlatched and opened.

The duration of the first phase of the washing program is such that at the beginning of the first phase water is fed in for about 30 seconds and that the machine remains idle thereafter for about 60 seconds prior to commencement of the proper washing program. During the entire first phase, i.e. for about 90 seconds, the drum will be monitored and any detected impermissible or atypical movement of the drum as may be caused by a child or animal will lead to the abortion or termination of the second phase of the washing program.

Alternatively, the first phase may be terminated immediately upon detection of impermissible movements in order to shorten the time any child may be in the drum and thus to reduce any traumatic experience.

Advantageously, the detection or recognition of a child or pet in the drum is carried out by an evaluation circuit.

The method is not limited in its application to the recognition of a child or animal being present in the drum of a washing machine, but it may be utilized to equal advantage to the detection of dogs, cats, rabbits birds or anything else which causes a washing machine drum to move impermissibly at a time when it should be stationary.

DETAILED DESCRIPTION OF THE SEVERAL DRAWINGS

Figure 2:
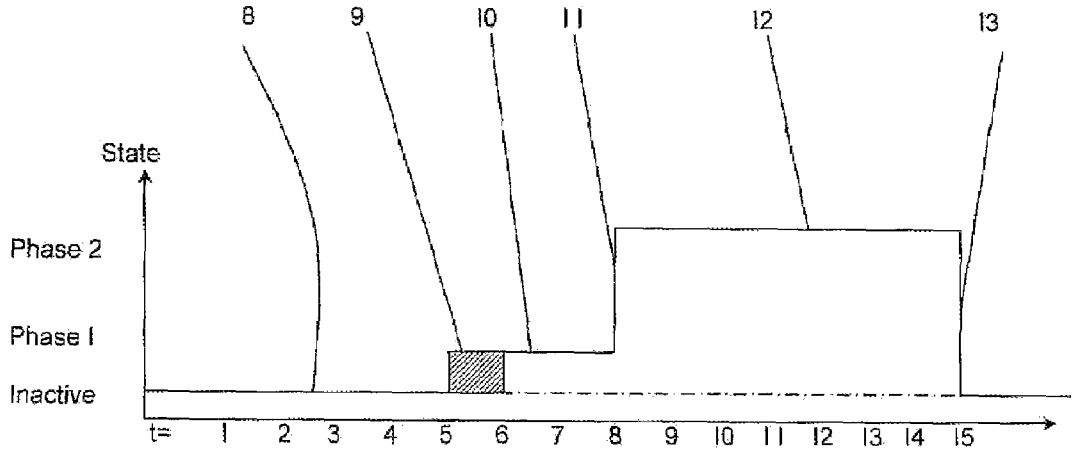
Figure 3:
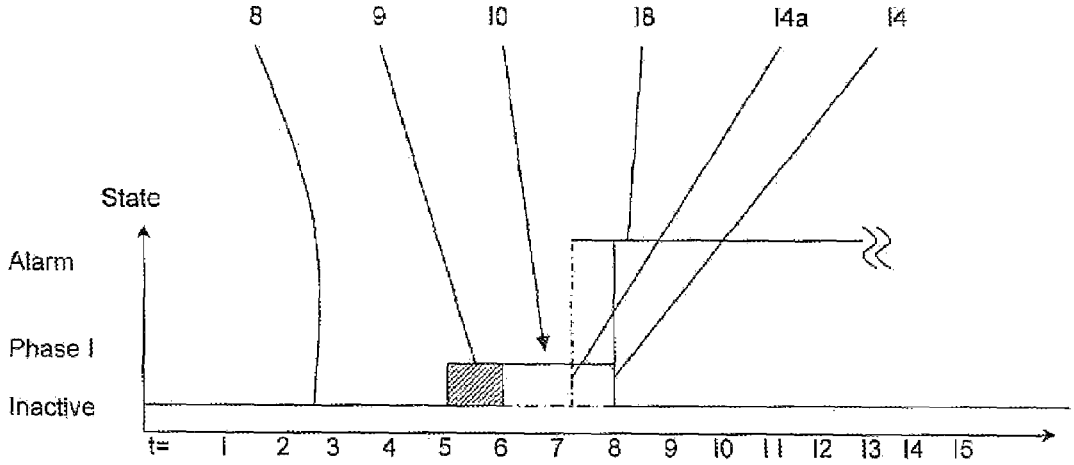

The novel features which are considered to be characteristic of the invention are set forth with particularity in the appended claims. The invention itself, however, in respect of its structure, construction and lay-out as well as its manufacturing techniques, together with other advantages and objects thereof, will be best understood from the following description of preferred embodiments when read in connection with the appended drawings, in which:

FIG. 1 is a schematic presentation of the arrangement of a washing aggregate within a housing;

FIG. 2 exemplarily depicts a diagram of the condition of a washing program in a normal situation; and FIG. 3 exemplarily depicts a diagram of the condition of a washing program in a faulty situation.

DETAILED DESCRIPTION OF THE PREFERRED EMBODIMENTS

As schematically shown in FIG. 1, the washing aggregate or washing fluid tub 2 is suspended by springs 3 for oscillatory movements within the housing 1 of a washing machine. The washing aggregate consists of a washing fluid tub 2 and drum 16 mounted for rotary movement within the tub 2. Rotary movement is at times imparted to the drum 16 by a motor 19 by way of a belt drive. Shock absorbers 4 are provided to prevent excessive oscillations in the case of imbalanced loads in the drum. A tachometer-generator 6 is provided to monitor rotational movements of the drum 16 during a normal washing program or load condition as well as during a first phase of the washing program at which time the drum 16 is not rotated by the motor 19. An evaluation unit 5 is connected by way of a line 7 to the tachometer-generator 6 to receive from it any values which may have been detected. A detergent chamber 15 is provided to receive and during a washing operation to dispense a predetermined amount of detergent and/or other washing agents. A loading opening 17 is closed after loading the laundry into the drum 16 and before starting a selected washing program.

FIG. 2 schematically depicts the chronological sequence of a washing program. During the idle phase 8, the washing machine is either switched off or the user has nor yet started the washing program. At time t=5 the start button 9 is actuated which activates the first phase 10 of the washing program. During the first phase, means such as a tachometer-generator 6 and an evaluation circuit 5 are activated for detecting any rotary movement of the washing drum 16 so that the drum 16 is monitored for rotary movements. If no impermissible movement of the drum 16 is detected during the first phase, the second phase 12 will follow the first phase 10 at time t=8. The second phase includes the actual washing program selected by the user. The second phase 12 or the washing program which includes washing, rinsing and spinning cycles with strong drum movements runs to its programmed termination 13.

It is useful at the beginning 9 of the first phase 10 to feed water, more particularly cold water, into the washing fluid tub 2 and washing drum 16. The duration of water feeding, the quantity of water and the temperature are set in such a way that any child who may be present in the drum 16 would be drenched or at least wetted and thus woken up or alarmed and induced to move without any danger to the child of his drowning or subcooling.

FIG. 3 by way of example depicts the chronological sequence of a program abortion 14. In this case, movement of the drum 16 was detected during the first phase 10 which led to premature termination 14 at time t=8 and to prevention of the program selected by the used from being continued. However, it would also be possible that at time t=7, upon detection of an impermissible movement, the first phase 10 is prematurely aborted 14*a* and thus terminated. Upon recognition of an impermissible movement and following program abortion 14, 14*a*, an audible or visible alarm 18 may be issued and/or the loading opening 17 may be automatically unlatched or opened.

What is claimed is:

1. A method of operating a washing machine comprising a housing, a loading door, a washing fluid tub suspended within the housing for oscillating movements, a washing drum disposed within the washing fluid tub, a motor configured to induce rotation movement to the washing drum, and a detector configured to detect rotary movement of the drum, the method comprising:

monitoring the rotary movement of the drum with the detector during a first phase of the washing program while the motor is inactive; and preventing continuation of the washing program in response to a detection of rotary movement of the drum that is not imparted by the motor during the first phase of the washing program.

2. The method of claim 1, further comprising unlatching the loading door of the washing machine upon detection of the rotary movement during the first phase.

3. The method of claim 2, further comprising opening the loading door.

4. The method of claim 1, further comprising issuing an alarm upon the detection of the rotary movement during the first phase.

5. The method of claim 4, wherein the alarm is an audible alarm.

6. The method of claim 4, wherein the alarm is a visible alarm.

* * * * *